United States Patent [19]

Hedström et al.

[11] 4,025,222

[45] May 24, 1977

[54] CONTROL VALVE UNIT FOR A HYDRAULIC SERVO MOTOR FOR A CONTROL VALVE OF A TURBINE

[75] Inventors: Martin Hedström; Carsten Olesen; Tyge Vind, all of Finspong, Sweden

[73] Assignee: Stal-Laval Turbin AB, Finspong, Sweden

[22] Filed: Nov. 10, 1975

[21] Appl. No.: 630,310

Related U.S. Application Data

[63] Continuation of Ser. No. 458,294, April 5, 1974, abandoned.

[30] Foreign Application Priority Data

Apr. 24, 1973 Sweden ..... 7305708

[52] U.S. Cl. ..... 415/43

[51] Int. Cl.[2] ..... F01D 17/04

[58] Field of Search ..... 415/36, 41, 42, 43; 251/26

[56] References Cited

UNITED STATES PATENTS 863,197 8/1907 Mattico ..... 251/26

3,027,137 3/1962 Eggenberger ..... 415/43

FOREIGN PATENTS OR APPLICATIONS 297,946 4/1954 Switzerland

*Primary Examiner*—Carlton R. Croyle
*Assistant Examiner*—Louis J. Casaregola
*Attorney, Agent, or Firm*—Eric Y. Munson

[57] ABSTRACT

A valve system for controlling the flow of hydraulic fluid for opening and closing the main control valve for a turbine system. The valve system comprises: first valve means for passing hydraulic fluid to the servo motor to maintain the control valve open during normal operating conditions of the turbine and to interrupt the supply of hydraulic fluid in response to a predetermined normal pressure drop; second valve means for draining hydraulic fluid from the servo motor to close the control valve in response to a predetermined normal pressure drop in the turbine system; and third valve means for separately draining hydraulic fluid from the servo motor to relieve the latter of pressure rapidly in response to an abnormal pressure drop in the turbine system with consequent rapid closing of the control valve.

1 Claim, 4 Drawing Figures

CONTROL VALVE UNIT FOR A HYDRAULIC SERVO MOTOR FOR A CONTROL VALVE OF A TURBINE

This is a continuation, of application Ser. No. 458,294 filed 4/5/74, now abandoned.

BACKGROUND OF THE INVENTION

In the operation of a turbine, for example a steam turbine, preferably for generation of electric power, great demands are placed on the control of the turbine, above all concerning its speed at varying loads and the control means available is then above all the control valve of the turbine by which the flow to the turbine can be regulated.

This regulation must then take all operational conditions into account, normal, slower variations in the load as well as suddenly arising situations such as loss of load, short-circuits of the electric supply networks and line breakdowns.

In order to cope with the demands for the control of the control valve, which is of considerable size in large turbines, said control valve is usually provided with a hydraulic servo motor, for example a piston moving in a hydraulic cylinder, for opening of the control valve while the closing is performed by means of a strong spring after the servo motor has been relieved of its hydraulic pressure.

The control of the servo motor is performed by means of a control valve unit by which the servo motor is connected to a hydraulic feeding source for opening of the control valve, or to an outlet when the control valve is to be closed.

This control valve unit is controlled from the control system of the turbine which, for normal operational conditions, comprises a turbine regulator for normal operation, normal starting and normal stopping. Parallel thereto is a release system for rapid closing of the control valve in the event of an emergency or serious faults such as line break-downs.

Whereas normal opening and closing operations of the control valve require a time elapse of several seconds and great precision, rapid closing should be effected in about 0.1 seconds or shorter. To be able to fulfill such diverse requirements with one and the same control valve unit it has hitherto been normal to arrange several regulating steps in succession with hydraulic amplifier steps therebetween, which is both expensive and complicated.

SUMMARY OF THE INVENTION

The present invention contemplates the splitting of the control valve unit into a first control valve means for normal operation, normal starting and normal stopping and a second valve means for rapid closing, which is indicated in the accompanying claims. Through this division of the valve unit into different parts for the various functions each part can be adapted to its particular function, with consequent simplification and improvement of the different parts.

The valve means for normal operation may consist of a two-way valve controlled by an analogous signal from the turbine regulator and connected to the servo motor and, on the other hand, to the feeding source and an outlet. Another possibility is to divide the normal operation between two valves, of which for opening the control valve is connected between servo motor and feeding source and the other one for closing the control valve is connected between servo motor and outlet. By giving these valves suitably small cross-sections they can be controlled by digital signals from the turbine regulator, which involves considerable advantages when constructing the entire system.

BRIEF DESCRIPTION OF THE DRAWING

In other respects the invention will be described more closely with reference to the accompanying drawings, in which FIG. 1 schematically shows a turbine plant with the proper control system while

DESCRIPTION OF AN EMBODIMENT OF THE INVENTION

Figure 1:
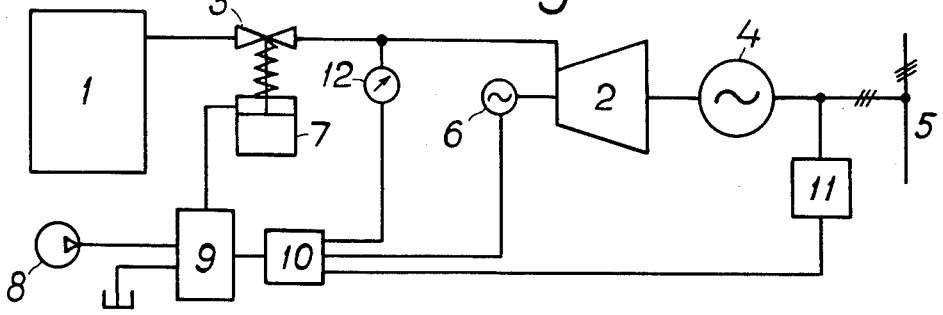

FIG. 1 shows a boiler 1 feeding a turbine 2 through a control valve 3. The turbine drives a generator 4 connected to an AC network 5. The turbine is further provided with a tachometer generator 6 which may be replaced by a frequency meter (not shown) in the network 5 or the generator 4.

The control valve 3 is opened by a sero motor 7 consisting of a piston in a pressure cylinder while the closig is effected automatically by means of a strong spring when the pressure in the servo motor is removed. The servo motor is fed from a feeding source in the form of a hydraulic pump 8 by way of a control valve unit 9 according to the invention, which will be further described with reference to FIGS. 2 –4. The valve unit 9 is controlled, in turn, by the control system 10 for the turbine, which, for example, may be connected to a power meter 11 in the network 5 and a pressure meter 12 in the main steam line. The control system 10 comprises control circuits and signal emitters for normal operation as well as safety and alarm circuits to release and rapidly close the main control valve 3 in the event of an emergency, but as these circuits are not included in the invention they will not be further described here.

Figure 2:
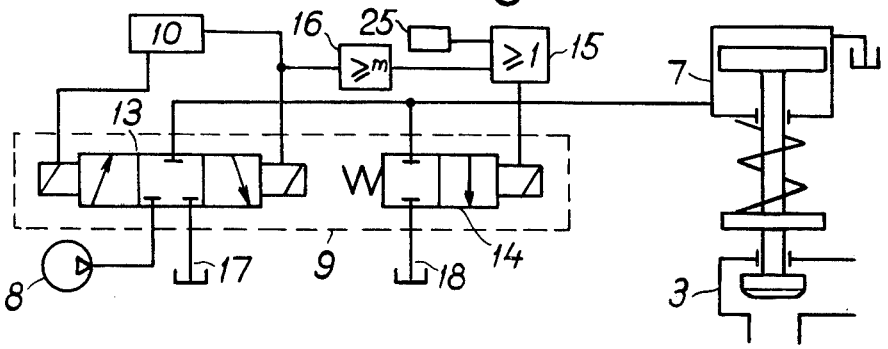
FIGS. 2 –4 show various control valve units according to the invention.

FIG. 2 shows the spring-loaded control valve 3 with its servo motor 7 a piston in a hydraulic cylinder which is fed from the pump 8 through the control valve unit 9. It comprises a first hydraulic control valve 13 and a release valve 14 for rapid closing of the control valve 3. By means of the control system 10 the hydraulic valve 13 is controlled in such a way that a signal to the left end of 13 opens the connection between the pump 8 and the servo motor 7, the piston therein being forced upwards and thus opening the valve 3. The valve 3 is closed by means of a signal transmitted to the right end of the hydraulic valve 13 which thus connects the servo motor 7 with the outlet 17. This causes the pressure in the servo motor to drop and the main valve 3 is closed by the pressure spring.

Rapid closing of the control valve 3 is effected by a signal transmitted to the valve 14 which then opens and connects the servo motor 7 with the outlet 18.

Compared with the hydraulic valve 13 the valve 14 is designed as a rapidly acting valve with a very strong operating member, and provided with a large through-flow opening to unsure that the pressure in the servo motor 7 is rapidly eleased and that the valve 3 is rapidly closed. As mentioned before, the hydraulic valve 13 may have a time lapse for operating the valve 3 of several seconds, whereas rapid closing of the valve 3 by means of the valve 14 is to be performed in about 0.1 seconds.

The valve 14 is controlled by way of an Or-gate 15 with two inputs, the upper one being connected to safety and alarm system 25 (not further shown), which transmits an opening signal to 14 in the event of a total loss of load on the turbine, break-downs in the line or other emergency situations which may give rise to serious damage to material and people.

As shown in FIG. 2 the control system 10 is suitably constructed so as to transmit analogous control signals to the valve 13, the operating time of which is thus defined by the signal effect. The closing signal from 10 to the right-hand end of the valve 13 can then, by way of a threshold value emitter 16, also be connected to the lower input on the Or-gate 15. In this way a stronger signal from 10, i.e. with a signal level above the threshold value *m*, through 16 will affect the valve 14 which then augments the closing operation from the valve 13. This is important, for example, in the case of major partial loss of load on the network 3, the valve 3 then being rapidly closed, but temporarily, i.e. until the signal from 10 falls below the level *m* so that the valve 14 is closed and the valve 13 alone takes over the control.

Figure 3:
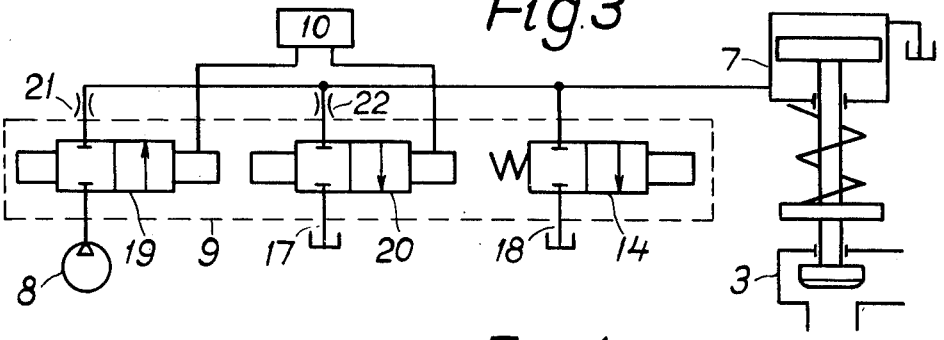
Figure 4:
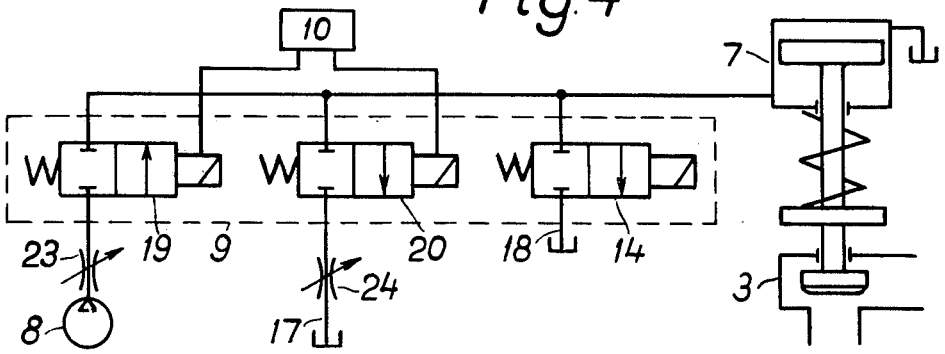

In FIGS. 3 and 4 the hydraulic valve 13 has been split up into two separate valves 19 and 20, so that the servo motor 7 is connected to the pump 8 over the first valve and to the outlet 17 over the second. In FIG. 3 the valves 19 and 20 have been symbolically connected in series with throttling means 21, 22, which can be accomplished in practice by providing the valves 19 and 20 with narrow through-flows. The advantage of having two valves 19, 20 with narrow through-flows is that the control system 10 can be constructed with digital control signals which is often an advantage in the control technique of today. However, this technique is predicated upon the basic idea of the invention, which resides in the feature that the function of rapid closing is separated from the normal control function by means of the valve 14, which makes it possible to construct the valves 13 or 19 and 20 only with regard to the control.

With digital signals from 10 the valves 19 and 20 will be alternatingly opened and closed completely for short periods, and the operating speed of the valve 3 is determined by the length of the signal pulses from 10.

In FIG. 4 the valves have also been connected in series with constant flow valves 23, 24. In this way it is possible to calculate in advance the exact amount of liquid in the valves 19 and 20 in relation to the signal pulses from 10, which facilitates a correct advance dimensioning and adjusting of the entire control system.

We claim:

1. A valve system for regulating the supply of hydraulic fluid to a servo motor which actuates the control valve between a turbine and its energy source, comprising:

a. turbine regulating means controlling the normal operation of the servo motor;

b. a source of hydraulic fluid;

c. passage means for circulating hydraulic fluid to and from said servo motor;

d. first valve means connected to said passage means for passing hydraulic fluid to said servo motor;

e. said first valve means being controlled by said turbine regulating means to supply hydraulic fluid to said servo motor to maintain said control valve open under normal operating conditions of the turbine and to interrupt the supply of hydraulic fluid in response to a predetermined decrease in turbine load;

f. second valve means connected to said passage means for draining hydraulic fluid from said servo motor;

g. said second valve means being controlled by said turbine regulating means to drain hydraulic fluid to close said control valve relatively slowly in response to a predetermined decrease in turbine load;

h. said first valve means and said second valve means both being controlled by said turbine regulating means to assume either a fully opened position or a fully closed position for predetermined periods of time in response to normal pressure drops;

i. third valve means connected to said passage means for separately draining hydraulic fluid from said servo motor to relieve the latter of hydraulic pressure rapidly in response to an abnormal decrease in turbine load with consequent rapid closing of the control valve;

j. said third valve means being maintained in closed position during said predetermined normal pressure drops and being actuated into drainage position upon a predetermined abnormal pressure drop in said passage means;

k. said first valve means and said second valve means including means for restricting the passage of hydraulic fluid relative to the passage of hydraulic fluid through said third valve means;

l. said restriction means being calibrated to provide a predetemined time lapse for closing and opening the control valve during normal operating conditions of the turbine.

* * * * *